US006534945B2

(12) United States Patent
Trimborn et al.

(10) Patent No.: US 6,534,945 B2
(45) Date of Patent: Mar. 18, 2003

(54) CREEL FOR A TEXTILE MACHINE PRODUCING CHEESES

(75) Inventors: Detlev Trimborn, Mönchengladbach (DE); Christian Sturm, Krefeld (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/932,138

(22) Filed: Aug. 17, 2001

(65) Prior Publication Data

US 2002/0021101 A1 Feb. 21, 2002

(30) Foreign Application Priority Data

Aug. 17, 2000 (DE) ..... P100 40 108

(51) Int. Cl.[7] ..... G05D 23/275
(52) U.S. Cl. ..... 318/634; 242/414
(58) Field of Search ..... 318/634, 362, 318/373; 242/410, 414, 909

(56) References Cited

U.S. PATENT DOCUMENTS

| | | | | |
|---|---|---|---|---|
| 3,792,329 A | | 2/1974 | Kuhnlein | |
| 4,112,663 A | | 9/1978 | Chrtek et al. | |
| 5,853,137 A | * | 12/1998 | Straaten et al. | 242/473.6 |
| 6,232,732 B1 | | 5/2001 | Haasen et al. | |
| 6,340,129 B1 | * | 1/2002 | Haasen et al. | 242/150 M |

FOREIGN PATENT DOCUMENTS

| | | |
|---|---|---|
| DE | PS 572 088 | 10/1933 |
| DE | 2106 898 | 8/1972 |
| DE | 27 14299 C2 | 1/1978 |
| DE | 214 114 | 10/1984 |
| DE | 39 11 505 A1 | 10/1990 |
| DE | 198 36 701 A1 | 2/2000 |
| DE | 198 58 548 A1 | 6/2000 |
| DE | 199 08 093 A1 | 8/2000 |
| EP | 0 618 165 A2 | 10/1994 |

* cited by examiner

*Primary Examiner*—Jeffrey Donels
(74) *Attorney, Agent, or Firm*—Kennedy Covington Lobdell & Hickman, LLP

(57) ABSTRACT

A creel (18) for a textile machine (1) producing cheeses (11), with a drive device (27) integrated into the creel (18) having an electromotor (35) which can be loaded with a braking current for braking the cheese (11) by initiating a braking moment directed counter to the rated current of the electromotor. A coolant circuit (36) is arranged inside the creel (18) for removal of the motor heat of the electromotor (35) of the drive device (27).

12 Claims, 5 Drawing Sheets

CREEL FOR A TEXTILE MACHINE PRODUCING CHEESES

CROSS-REFERENCES TO RELATED APPLICATIONS

This application claims the benefit of German patent application DEP10040108.2 filed Aug. 17, 2000, herein incorporated by reference.

FIELD OF THE INVENTION

The present invention relates to a creel for a textile cheese-producing machine and, more particularly, to such a creel which comprises an integrated electromotor drive device which can be loaded or charged with a braking current counter to the nominal rated current of the electromotor for braking the cheese.

BACKGROUND OF THE INVENTION

Such creels are known, e.g., in conjunction with bobbin winding devices that were developed for the production of cheeses of the "precision winding" and "stepped precision winding" types.

Subsequently published German Patent Publication DE 199 08 093.3, for example, describes a bobbin winding device in which a cheese held in a creel is directly driven by a drive motor integrated into the creel. The cheese rests on a pressure roller that is not driven itself. Traversing of the yarn to be wound takes place by means of a finger-like yarn guide operated by a separate drive. The two drives can be controlled via an appropriate control device such that a defined, pre-selectable winding ratio is always obtained.

Since it is necessary to stop a cheese frequently in the course of the overall process of winding yarn onto the cheese, for example, when a yarn supply cop is exhausted, upon a yarn break, or following a controlled cutting of the yarn via a yarn cleaner, the known winding device also comprises a pneumatically loadable braking device integrated into the creel. This known braking device is comprised of a brake lining fixed on the stator housing of the electromotor to rotate in unison with the housing, against which brake lining a contact surface of a tube receiving plate, embodied as a brake disk, can be pneumatically pressed. The braking force thereby produced rapidly brings the cheese to a stop.

However, this known cheese winding device has a number of disadvantages. Both the rotating brake disk and the stationary brake lining are subject to significant wear and therefore the braking device requires intensive maintenance. In addition, the brake dust created can readily enter into the axial sliding guide of the cheese drive as well as into the bearing of the electromotor and considerably hampers or may even cause breakdown of these components.

Other cheese winding devices are known, for example from German Patent Publication DE 198 36 701 A1, in which a grooved drum that drives the cheese and at the same time traverses the yarn is electrically braked to a standstill after the cheese has been lifted off. To this end, the drive motor of the grooved drum is loaded or charged with a braking current that is usually a multiple of the rated current of the drive motor. In the process, the drive motors of such cheese winding devices are subjected to considerable loads, especially when large cheeses must be repeatedly braked and accelerated at short time intervals. Thus, such drives are exposed to significant stresses, especially thermal loads.

It is known from German Patent Publications DE 21 06 898 A1 or German Patent DD 214,114 that textile machine drive devices which are subjected to large thermal loads can be provided with cooling ribs so that the motor heat can be removed via convection and radiation into the ambient environment. Alternatively, as described in German Patent DE 27 14 299 C2, such drive devices can be cooled by a permanent application of compressed air.

These known drive devices are comparatively large, bulky and heavy, especially when correspondingly large output data are demanded. However, drive devices which are intended to be integrated directly into the creel of a cheese-producing textile machine must be as small and lightweight as possible, since during the winding process their weight results in an additional unwanted load on the rotation of the cheese on the associated pressure roller, especially when such a drive device is arranged far to the front on the creel. Thus, these known drive devices are only very poorly suited for being integrated in the creel of a textile cheese-producing machine. Therefore, such drive devices arranged in the area of the tube receiving plates of a creel should be as lightweight as possible but nevertheless strong in performance. However, the achievable power strength of an electromotor, e.g., of an electronically commuted direct-current motor is considerably dependent on the magnitude of its removable heat flow.

SUMMARY OF THE INVENTION

In view of the previously described state of the art, the present invention therefore seeks to address the problem of overcoming the disadvantages of the devices known in the state of the art and, more particularly, the present invention seeks to develop a creel that makes it possible to use relatively small and therewith lighter weight drive devices with great power density while assuring a sufficiently great strength of the drive devices.

The present invention addresses this problem by providing a creel of the type basically comprising an electromotor drive device integrated into the creel, wherein the creel may be braked when necessary by loading the electromotor with a braking current which initiates a braking moment directed counter to a rated current of the electromotor. In accordance with the present invention, a coolant circuit is arranged inside the creel for removal of motor heat from the electromotor.

The design of the creel in accordance with the invention has the particular advantage that the motor heat produced by the electromotor is immediately distributed onto a relatively large cooling surface. This assures that a thermal overloading of relatively small drive devices is prevented, even when they are fully loaded, and safety cutoffs due to overheated drives, that result in losses of efficiency of the textile machines, are avoided.

In a preferred embodiment, the coolant circuit comprises a heat receiving extent in the area of the electromotor and a cooling extent that is distinctly longer in comparison to the heat receiving extent. The cooling extent is formed to extend either within one of two creel arms or within the complete creel. In both instances, the creel wall located in the area of the cooling extent acts as a heat exchanger so that a large part of the motor heat produced can be removed over a large surface area and thereby dissipated into the environment.

The coolant circuit is preferably embodied as a closed system, i.e., the coolant circulates within the system without direct contact with the environment. Either a liquid, preferably water, or a gas, preferably air, may be used as coolant.

In an advantageous embodiment, the circulation of the coolant takes place via free convection wherein the change of density of the coolant occurring due to the heating of the coolant in the area of the heat receiving extent causes the coolant to flow inside the cooling circuit and thereby transports the introduced motor heat from the heat receiving extent to the cooling extent where the heat is removed via the creel wall into the environment.

In an alternative embodiment, the transport of heat within the coolant circuit may be supported by forced convection. In this instance, depending upon the type of the coolant used, either a ventilator or a liquid pump is arranged inside the coolant circuit. The use of such an additional, external power source can increase the circulation of the coolant inside the coolant circuit and therewith improve the cooling performance of the device.

It is also possible to design the coolant circuit as a partially-closed circuit, wherein compressed air is constantly or temporarily blown via an injector nozzle into the coolant circuit and the circulation of the coolant supported therewith. Excess compressed air is removed thereby through an appropriate air evacuation bore.

Further details, features and advantages of the present invention will be described in and understood from an exemplary embodiment described hereinbelow with reference to the accompanying drawings.

DESCRIPTION OF THE PREFERRED EMBODIMENTS

Figure 1:
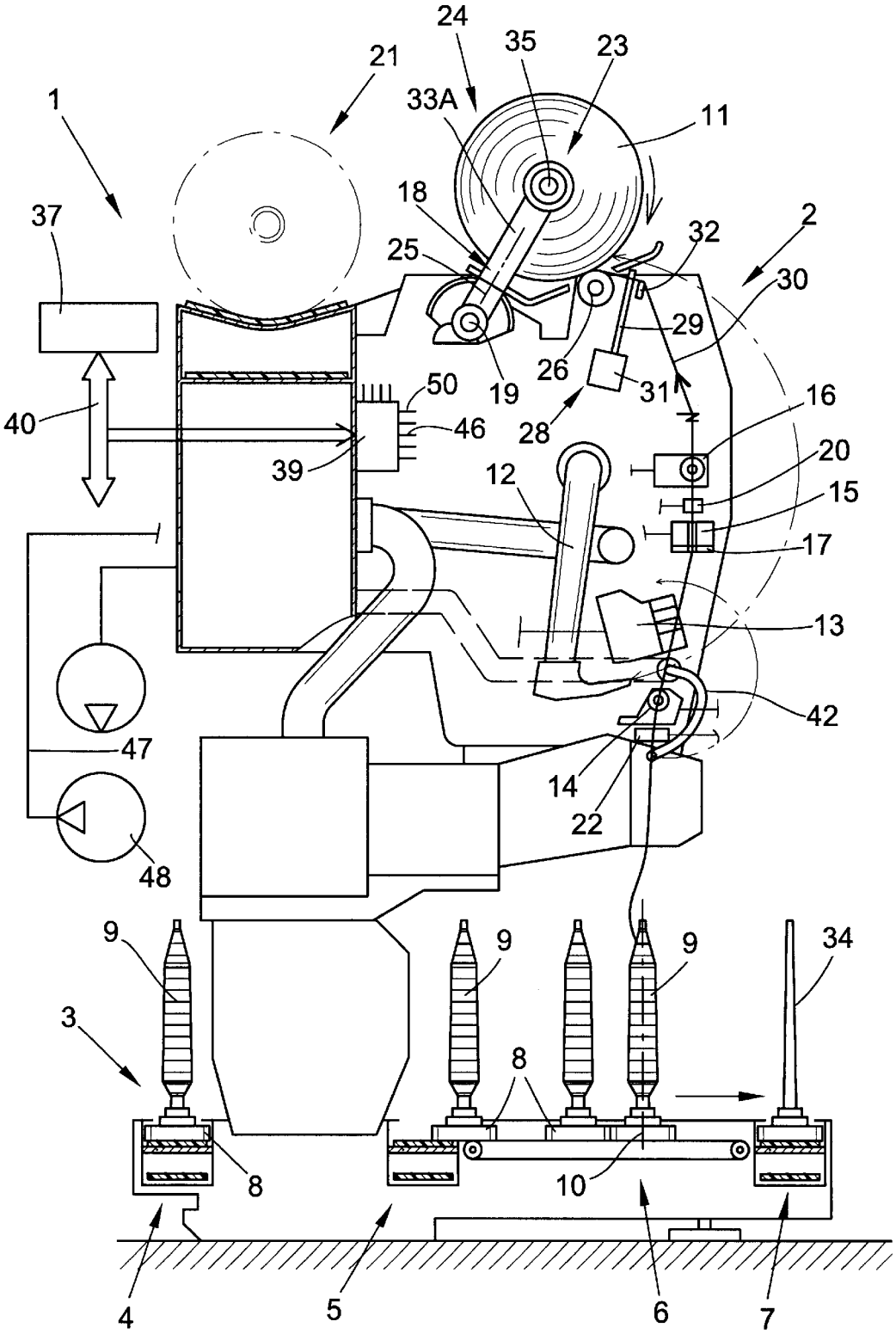
FIG. 1 is a partially schematic side elevational view of a work station of a textile cheese-producing machine incorporating the coolant circuit of the present invention.

Referring now to the accompanying drawings and initially to FIG. 1, a textile cheese-producing machine, preferably an automatic cheese winder in this exemplary embodiment, is schematically shown in a side elevational view and is designated in its entirety by reference numeral 1.

Such automatic cheese winders customarily comprise a plurality of similar work stations, in the present instance cheese winding stations 2, commonly referred to as winding heads, aligned with one another between the end frames (not shown) of the machine.

Textile yarn from spinning cops 9 manufactured on a ring spinning machine are rewound by these winding heads 2 onto large-volume cheeses 11 in a manner that is already known and therefore need not be explained in more detail. After the production of each cheese 11 has been completed, the cheese 11 is transferred onto cheese transport device 21 running the length of the machine, e.g., by pivoting creel 18 about pivot axis 19, and the cheese 11 is thereby transported to a bobbin loading station or the like (not shown) arranged at an end of the winding machine.

Additionally, such automatic cheese winders 1 customarily comprise a logistic device in the form of a bobbin and tube transport system 3. Spinning cops 9 and empty cop tubes 34 are supported on transport plates 8 in upstanding disposition and these transport plates 8 are circulated within the machine via various conveyor runs of this logistic device. FIG. 1 shows only the following parts of a known bobbin and tube transport system 3: Cop feed conveyor 4, storage conveyor 5, which can be driven in a reversing manner, one of transversal transport conveyor 6 running to winding heads 2 as well as tube return conveyor 7. The spinning cops 9 thusly transported are rewound to large-volume cheeses 11 at the unwinding position 10 located along each transversal transport conveyor 6 at the associated winding head 2.

In addition, such an automatic cheese winder comprises a central control unit 37 connected via machine bus 40 to the separate winding-head computers 39 of the individual winding heads 2.

As is known and therefore only schematically indicated, each individual winding head 2 comprises various devices that make possible an orderly operation of these work stations. As depicted in FIG. 1, a yarn 30 being rewound at the winding head 2 travels from spinning cop 9 to cheese 11 along a path adjacent which various operational devices are provided to perform various operations as a part of the winding process, e.g., a yarn suction nozzle 12, a yarn grasping tube 42, a splicing device 13, a yarn tensioning device 14, a yarn cleaner 15, a paraffin application system 16, a yam cutting device 17, a yarn tension sensor 20 and an underyarn sensor 22.

Each winding head 2 includes a cheese winding device, designated in its entirety by reference numeral 24, which comprises creel 18 supported in such a manner that it can move about pivot axis 19. Creel 18 can also be pivoted about axis 25, e.g., to manufacture conical cheeses.

During the winding process, the driven cheese 11 rests with its surface on pressure roller 26 and frictionally entrains this pressure roller 26, that has no drive. The cheese 11 is driven via drive device 27 with speed control. This drive device 27 is embodied, e.g., as electronically commutable direct-current motor 35 and is arranged in bearing housing 23 in such a manner that it can be shifted, as indicated in FIGS. 2 to 7. This bearing housing 23 is formed on one of creel arms 33A or 33B.

Yarn traversing device 28 is provided to traverse yam 30 during the winding process. Such a traversing device is only indicated schematically in FIG. 1 and is described in detail in German Patent Publication DE 198 58 548 A1. Yarn traversing device 28 is basically comprised of yarn guide 29 in the form of a finger which is loaded by electromechanical drive 31 to traverse yarn 30 between the two front sides of cheese 11. Yarn 30 glides during its displacement by yarn guide 29 on guide edge 32.

Figure 2:
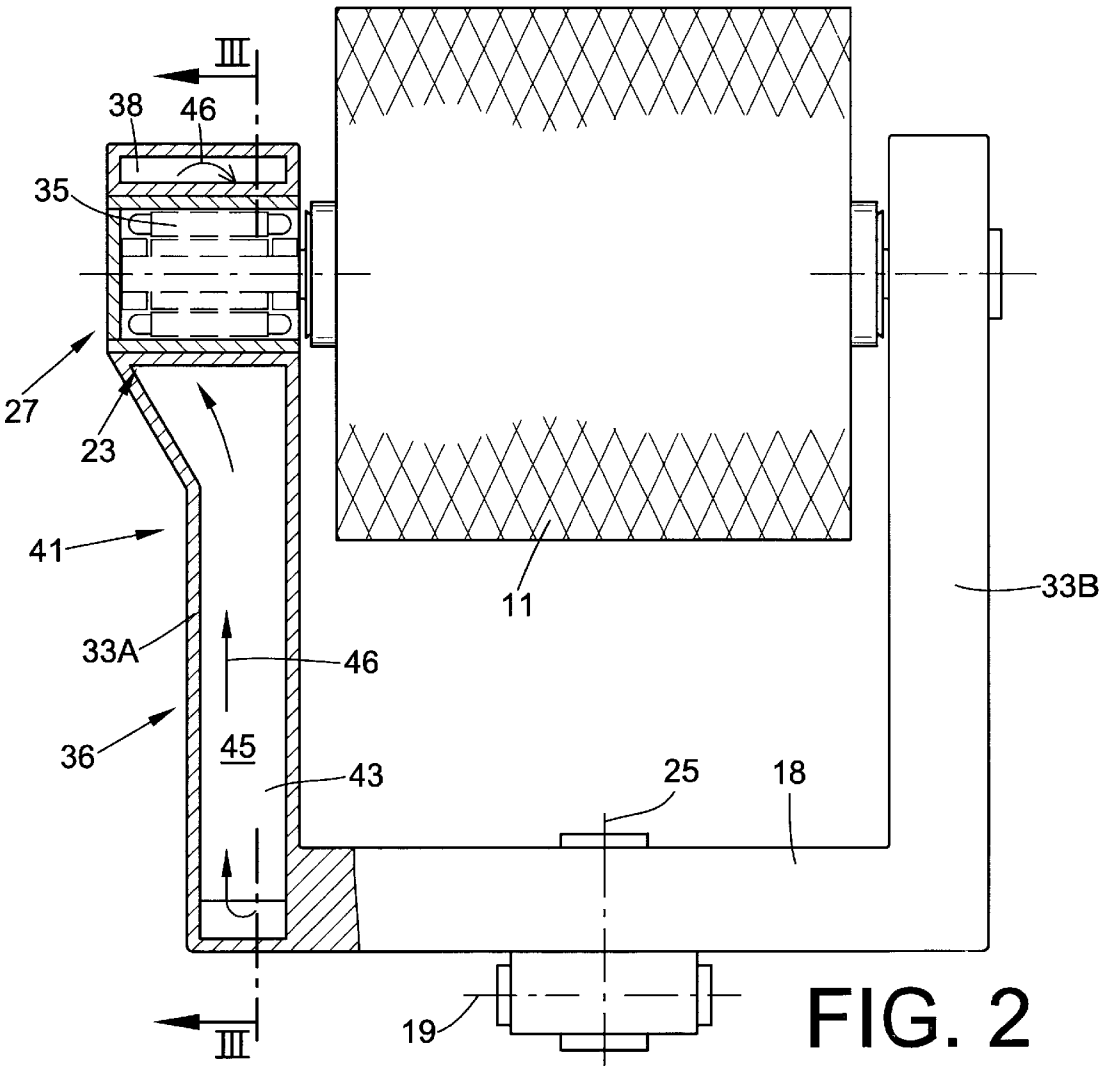
FIG. 2 is a top view, partially in cross-section, of a creel according to a first embodiment of the present invention providing an integrated coolant circuit.

FIG. 2 shows a top view of a first embodiment of creel 18 of the present invention. As shown, a closed coolant circuit 36 is integrated in creel arm 33A, which circuit is comprised of heat receiving extent 38 and of cooling extent 41, which is, as a rule, distinctly longer. Heat receiving extent 38 is arranged in the area of drive device 27 and surrounds electromotor 35 almost completely. Heat receiving extent 38 is followed, as shown, by cooling extent 41 that comprises two conduits 44, 45 separated by intermediate wall 43. A coolant circulates inside coolant circuit 36 by the process of free convection in the exemplary embodiment according to FIGS. 2 and 3. The direction of flow of this coolant, either a liquid, e.g., water, or a gas, e.g., air, is indicated by arrows 46. The coolant dissipates the motor heat, taken up in the area of heat receiving extent 38, into the ambient environment as the coolant moves through the area of cooling extent 41 via the walls of creel arm 33A which provide a sufficiently large surface area for dissipating the heat and, thus, the coolant assures that the motor temperature of direct-current motor 35, that is preferably electronically commuted, does not exceed a limit value.

Figure 3:
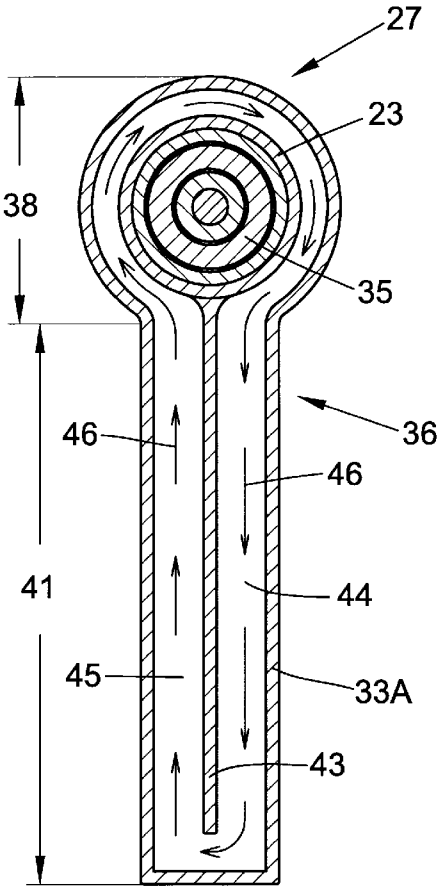
FIG. 3 is a cross-sectional view of the creel of FIG. 2 taken along line III—III thereof.
Figure 4:
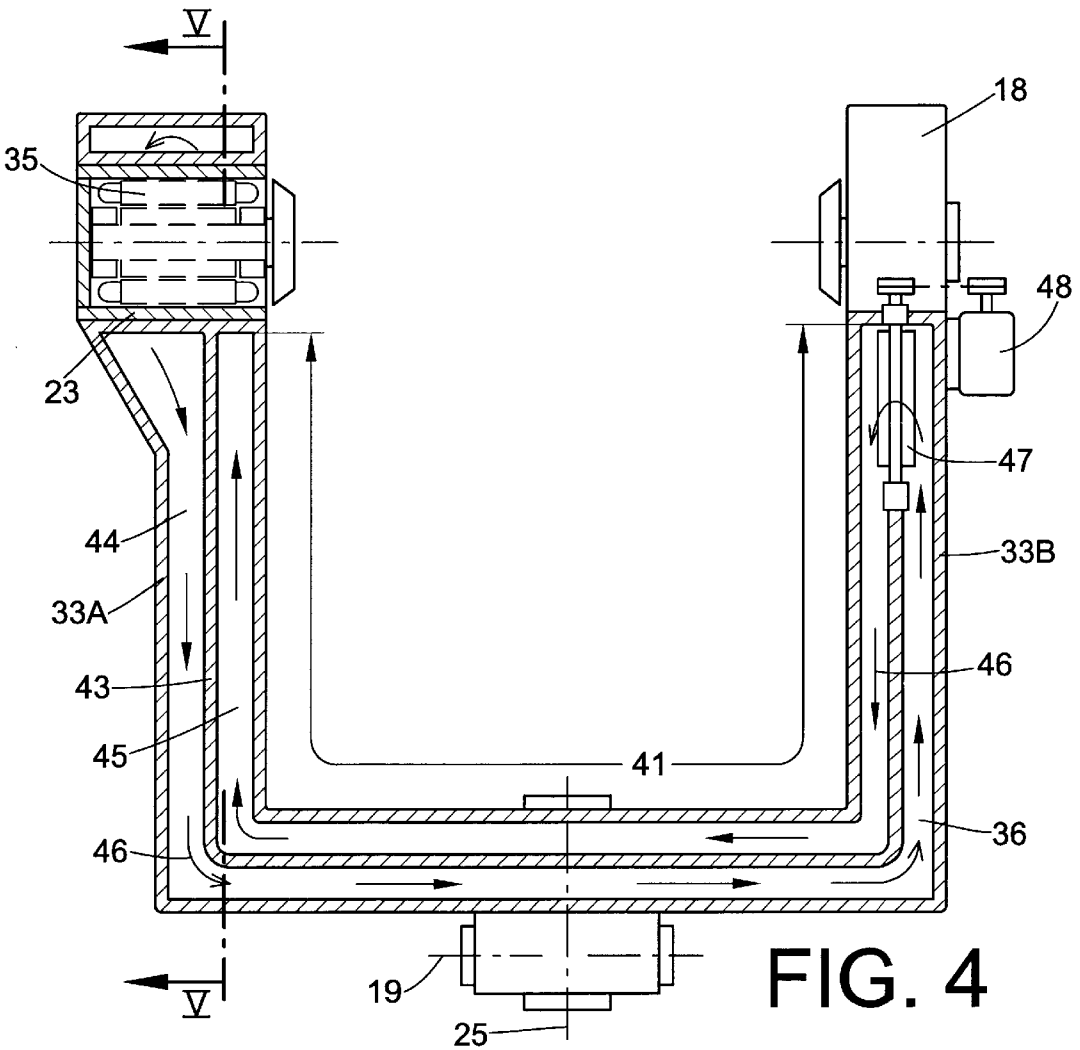
FIG. 4 is another cross-sectioned top view, similar to FIG. 2, of a creel according to a second embodiment of the present invention providing a ventilator arranged inside the coolant circuit.
Figure 5:
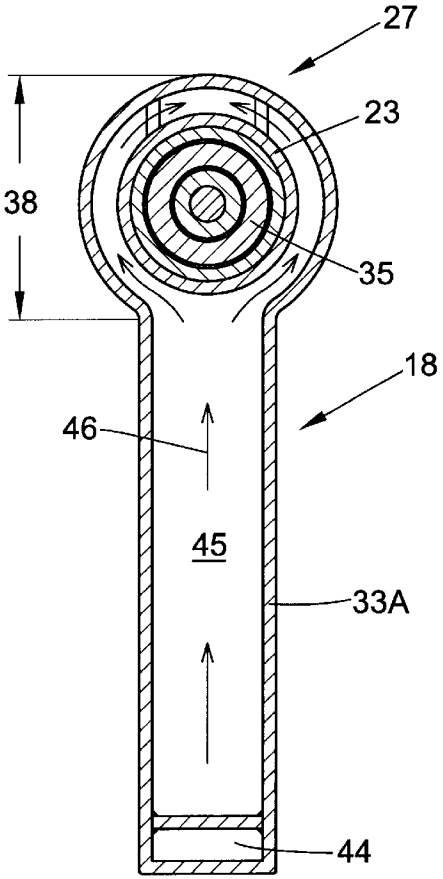
FIG. 5 is a cross-sectional view of the creel of FIG. 4 taken along line V—V thereof.
Figure 6:
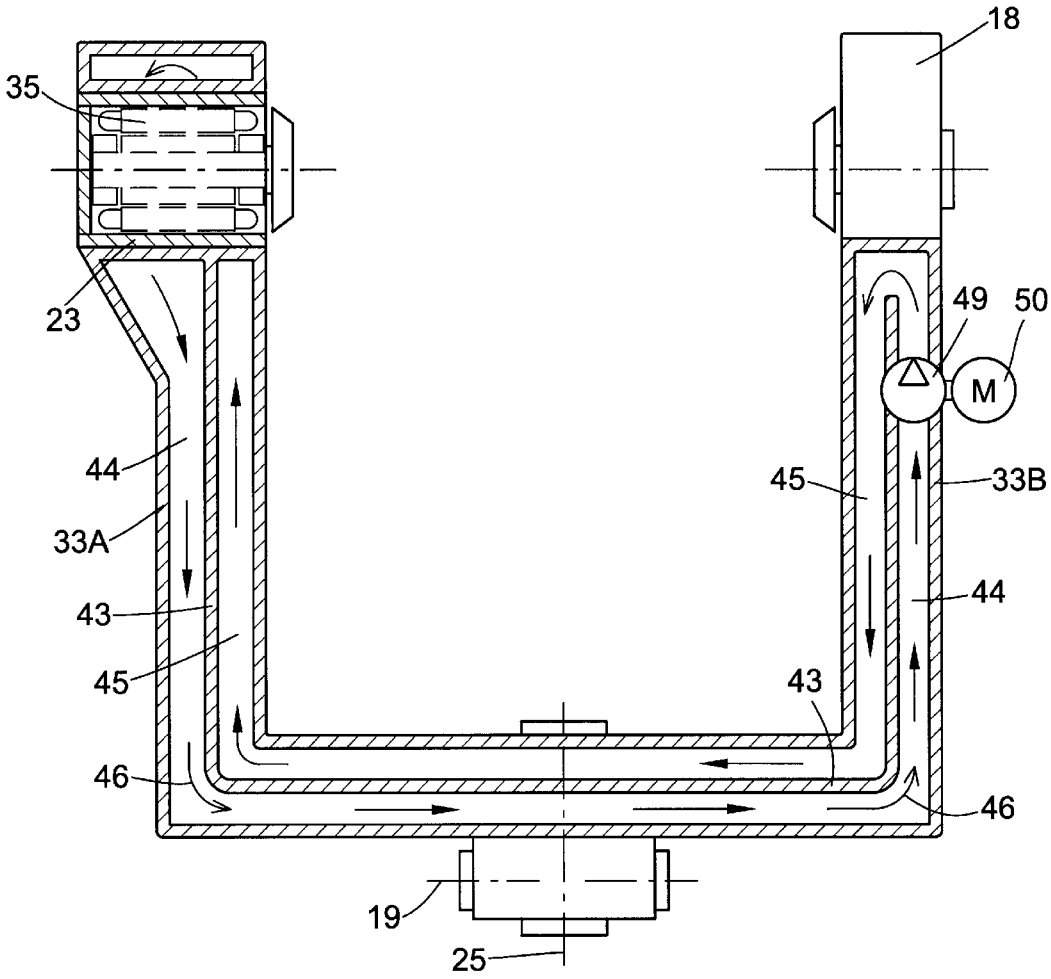
FIG. 6 is another cross-sectioned top view, similar to FIGS. 2 and 4, of a creel according to a third embodiment of the present invention providing a liquid pump arranged inside the coolant circuit.

The exemplary embodiments of FIGS. 4, 5 and 6 differ from the previously described embodiment of FIGS. 2 and 3 essentially in that almost the entire creel 18 functions as a heat exchanger rather than only one creel arm serving as the cooling surface. Thus, coolant circuit 36 is arranged in both creel arms 33A, 33B as well as in the creel base connecting the creel arms. Moreover, in the exemplary embodiment of FIGS. 4, 5 and 6, the flow 46 of the coolant is supported by a forced convection.

Specifically, a flow producer 47, 49 is connected into coolant circuit 36, preferably in the area of creel arm 33B, which producer constantly accelerates the coolant. The flow producer is either embodied as a ventilator 47 (FIG. 4) if a gas is used as coolant, which ventilator is loaded by drive 48, or as a liquid pump 49 (FIG. 6) if a liquid is used as coolant, which pump is also loaded by corresponding drive 50.

Figure 7:
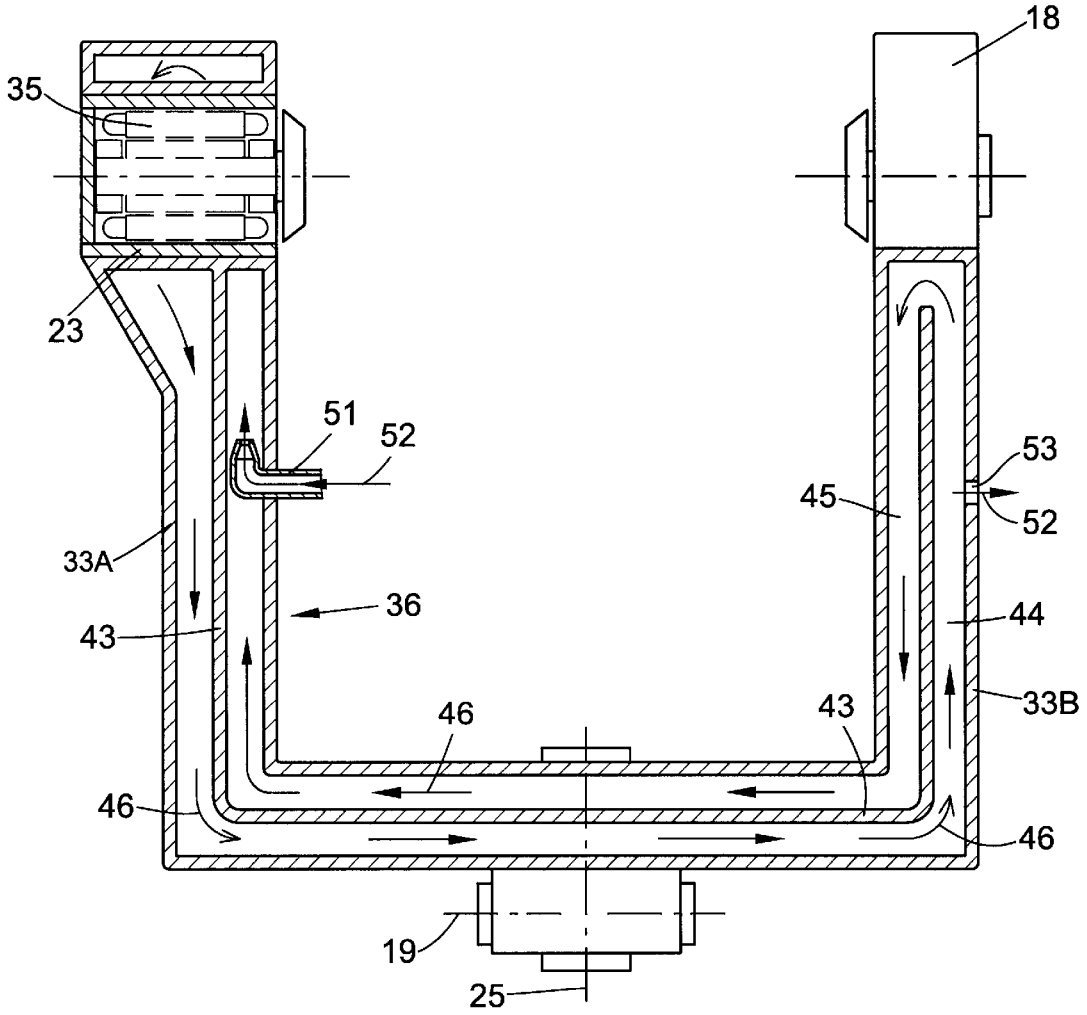
FIG. 7 is another cross-sectioned top view, similar to FIGS. 2, 4 and 6, of a creel according to a fourth embodiment of the present invention providing a half-closed coolant circuit.

FIG. 7 shows a creel 18 with a partially closed coolant circuit 36 wherein compressed air 52 is permanently or temporarily blown into cooling circuit 36 via injector nozzle 51 arranged, e.g., in the area of creel arm 33A, which results in an elevated circulation of the coolant, in this case air. Excess compressed air is removed via air evacuation bore 53 arranged, e.g., in the area of creel arm 33B.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A creel of a textile machine producing cheeses, comprising a drive device integrated into the creel, the drive device having an electromotor which can be loaded with a braking current for initiating a braking moment directed counter to a rated current of the electromotor for braking the cheese, and a coolant circuit arranged inside the creel for removal of motor heat of the electromotor.

2. The creel according to claim 1, wherein the coolant circuit comprises a heat receiving extent surrounding the electromotor and a cooling extent extending into a creel arm of the creel.

3. The creel according to claim 1, wherein the coolant circuit is a closed system.

4. The creel according to claim 1, wherein a coolant is disposed inside the coolant circuit to be heated by the motor heat of the electromotor and the coolant is adapted for free convection flow within the coolant circuit.

5. The creel according to claim 4, wherein the coolant is a liquid.

6. The creel according to claim 4, wherein the coolant is water.

7. The creel according to claim 4, wherein the coolant is a gas.

8. The creel according to claim 4, wherein the coolant is air.

9. The creel according to claim 4, wherein a flow producer is disposed within the coolant circuit for initiating a forced convection of the coolant.

10. The creel according to claim 9, wherein the flow producer comprises a liquid pump.

11. The creel according to claim 9, wherein the flow producer comprises a ventilator.

12. The creel according to claim 1, wherein the coolant circuit is partially closed, and an injector nozzle and an air evacuation bore are disposed within the partially closed coolant circuit.

* * * * *